US008925981B2

(12) United States Patent
Ray, II

(10) Patent No.: US 8,925,981 B2
(45) Date of Patent: Jan. 6, 2015

(54) METHOD AND APPARATUS FOR LOCKING AN ELEVATOR OR TRANSPORT SYSTEM

(76) Inventor: John W. Ray, II, Grand Junction, CO (US)

( * ) Notice: Subject to any disclaimer, the term of this patent is extended or adjusted under 35 U.S.C. 154(b) by 583 days.

(21) Appl. No.: 13/088,746

(22) Filed: Apr. 18, 2011

(65) Prior Publication Data

US 2012/0091735 A1 Apr. 19, 2012

Related U.S. Application Data

(63) Continuation-in-part of application No. 29/377,082, filed on Oct. 15, 2010, now Pat. No. Des. 639,137.

(51) Int. Cl.

| | |
|---|---|
| ***E05C 1/06*** | (2006.01) |
| ***B66B 13/16*** | (2006.01) |
| ***E05B 47/02*** | (2006.01) |
| ***E05B 65/00*** | (2006.01) |
| *E05B 63/04* | (2006.01) |
| *E05B 47/00* | (2006.01) |

(52) U.S. Cl.

CPC ..... *B66B 13/16* (2013.01); *E05B 47/026* (2013.01); *E05B 65/00* (2013.01); *E05B 63/042* (2013.01); *E05B 2047/0073* (2013.01)

USPC ..... 292/140; 292/144

(58) Field of Classification Search

USPC ..... 292/140, 144

See application file for complete search history.

(56) References Cited

U.S. PATENT DOCUMENTS

| | | | | |
|---|---|---|---|---|
| 1,684,980 | A * | 9/1928 | Ward et al. | 70/282 |
| 3,371,947 | A * | 3/1968 | Gridley | 292/144 |
| 4,620,735 | A * | 11/1986 | Heydner | 292/144 |
| 5,918,704 | A * | 7/1999 | Chevilliard et al. | 187/335 |
| 7,334,665 | B2 | 2/2008 | Smith et al. | |
| 7,549,516 | B2 * | 6/2009 | Eisenhower et al. | 187/331 |
| 7,823,699 | B2 | 11/2010 | Gieras et al. | |

* cited by examiner

*Primary Examiner* — Mark Williams

(74) *Attorney, Agent, or Firm* — The Reilly Intellectual Property Law Firm, P.C.

(57) ABSTRACT

A locking system for a hoistway door having an elongated casing, a slider member operatively connected to an electromechanical system for upward and downward movement of the slider. A keeper associated with the locking system allowing for secure locking and unlocking of the hoistway door.

8 Claims, 10 Drawing Sheets

METHOD AND APPARATUS FOR LOCKING AN ELEVATOR OR TRANSPORT SYSTEM

CROSS-REFERENCE TO RELATED APPLICATION

This application is a continuation-in-part of Design patent application Ser. No. 29/377,082 filed 15 Oct. 2010, for Safety Lock by John W. Ray II and assigned to the assignee of this invention and incorporated by reference herein.

BACKGROUND

The following is a method and apparatus for a secure locking system, more particularly a method and device for locking an elevator or transport system.

Mechanical hoisting systems such as elevators and dumbwaiters require a reliable mechanism to limit access to the system and prevent unwanted injuries. All such hoisting systems have at least two points of entry and may have more depending upon the number of floors served and whether the lift is designed to be accessible from more than one point of entry on any floor. At every station is an entry door equipped with a form of locking mechanism, or interlock, that prevents the door from opening unless the lift is in place at that door. Interlocks are typically used to insure proper locking, allowing the elevator door to only open when the elevator is present and preventing opening when it is unsafe to do so. The interlock typically is mounted to a door frame and is compatible with a locking fixture, or keeper, mounted to the door. The interlock and keeper engage to create a secure locking connection that is typically controlled by an electromechanical device that is activated when an electrical current is applied.

There is described herein a hoisting system having at least one hoistway door movable between an open position and a closed position, a locking apparatus having an elongated housing with an interior channel and at least one keeper-receiving opening communicating with one side of the channel, a slider member movable through the channel into a position at least partially closing the keeper-receiving opening, a drive member for selectively advancing the slider member at least partially across the keeper-receiving opening and for selectively retracting the slider member away from the keeper-receiving opening, and a keeper mounted on a swinging door for slidable advancement transversely across the path of advancement of the slider member whereupon advancement of the slider member partially closing the opening will engage the keeper member to retain the hoistway door in a closed position. The above and other features will become more readily appreciated and understood from a consideration of the following detailed description of different embodiments when taken together with the accompanying drawings in which:

DRAWINGS

DETAILED DESCRIPTION

FIGS. 1 through 12 show different forms of an electromechanical door lock assembly having a housing that accommodates a slider member and an electromechanical system that is engageable with a keeper member allowing locking and unlocking of a hoistway door.

Figure 1:
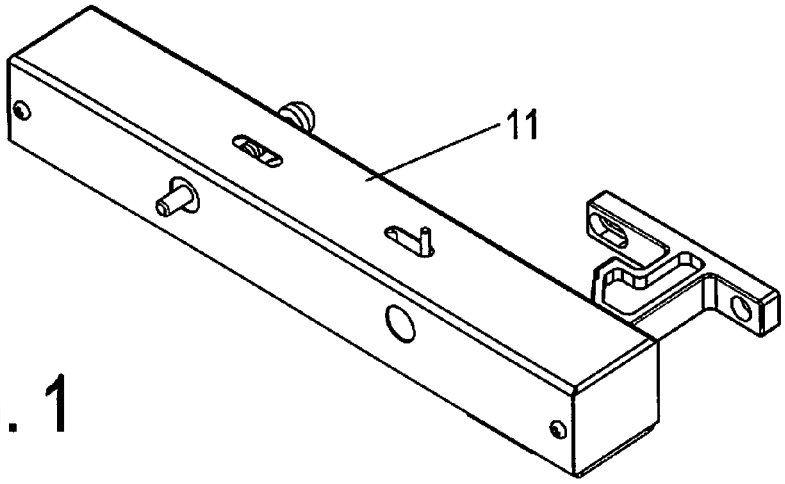
FIG. 1 is a perspective view of a secure lock device.
Figure 2:
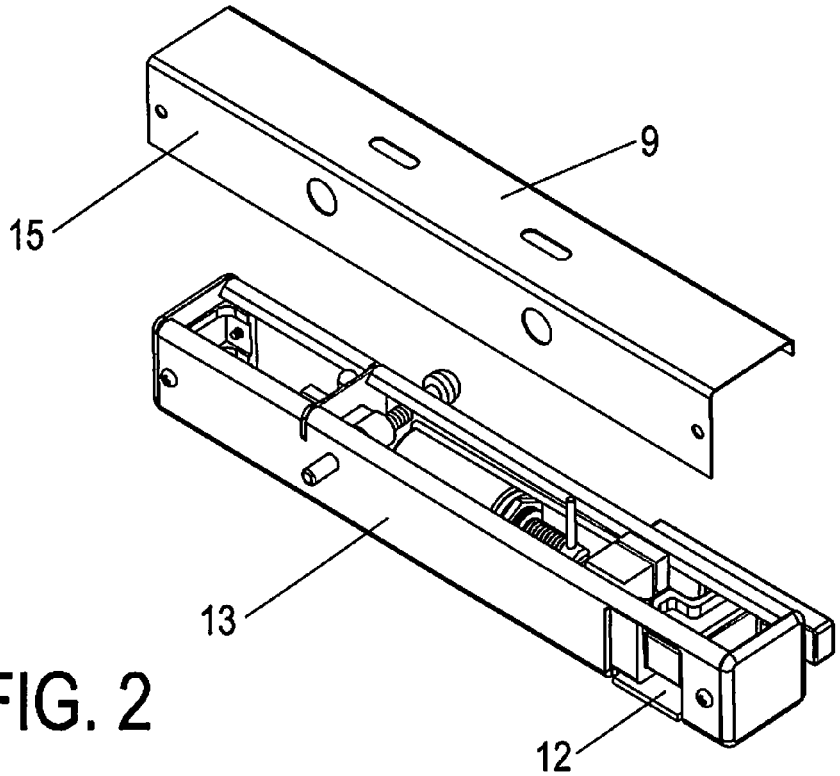
FIG. 2 is a partially exploded view of FIG. 1.
Figure 3:
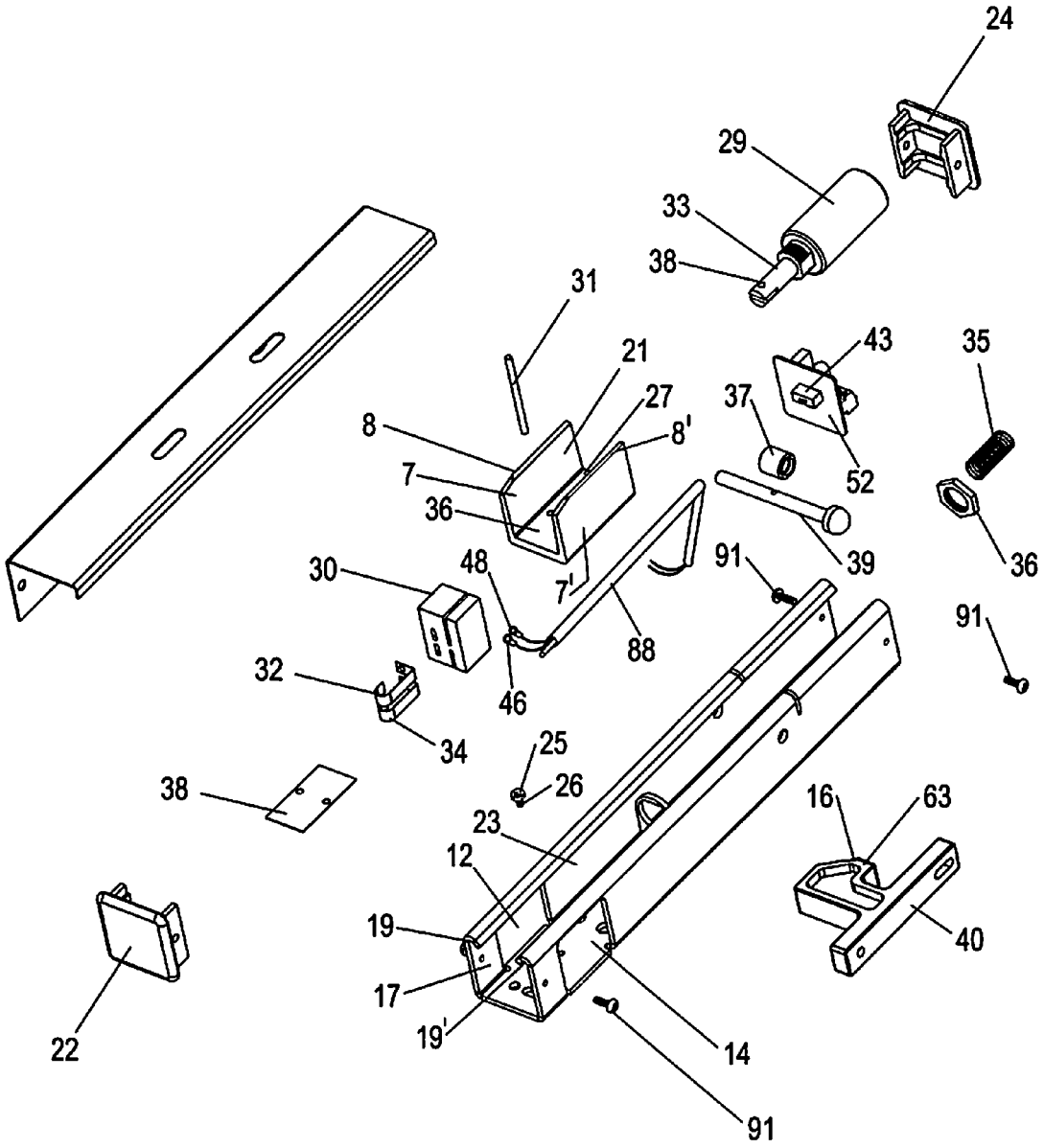
FIG. 3 is a fully exploded view of FIG. 1.
Figure 4:
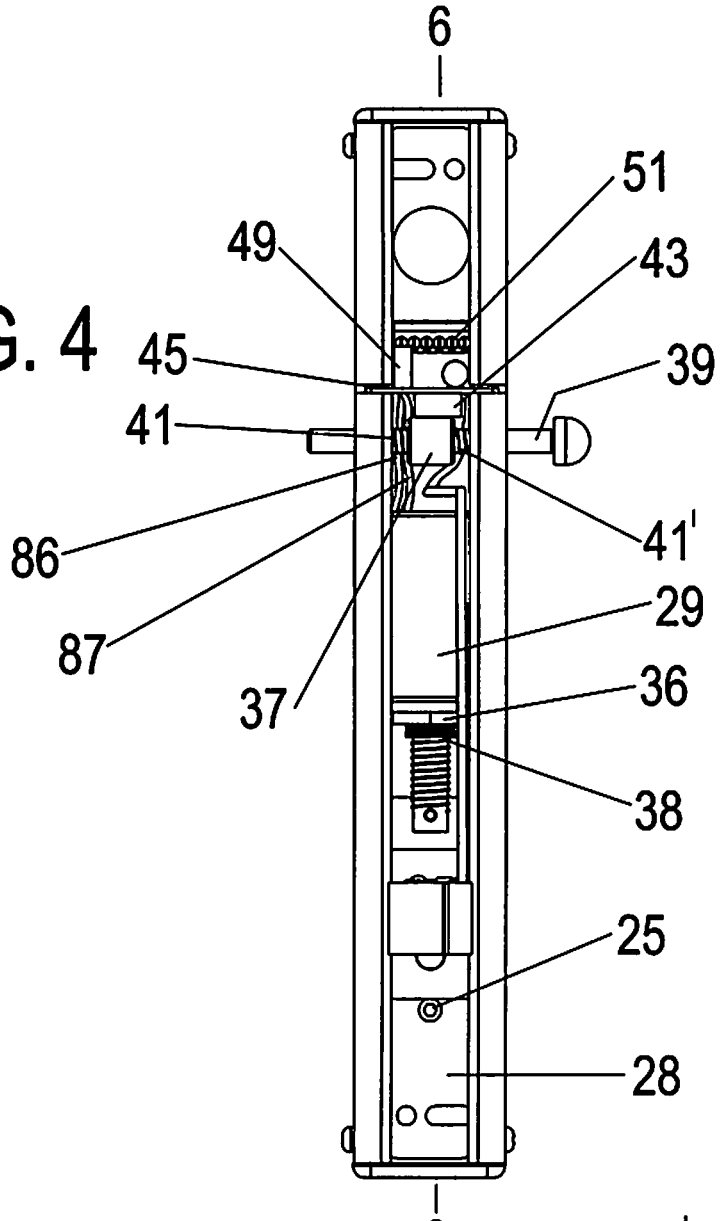
FIG. 4 is a front view in elevation of FIG. 1.
Figure 5:
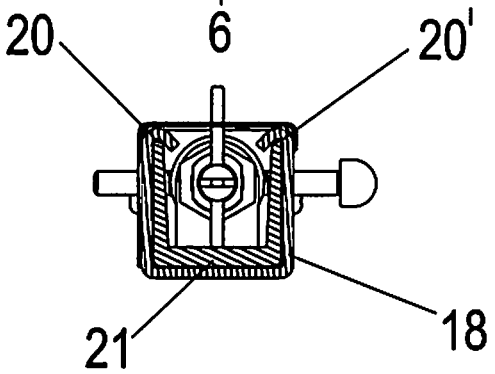
FIG. 5 is a cross-sectional view taken about lines 5-5 of FIG. 4.
Figure 6:
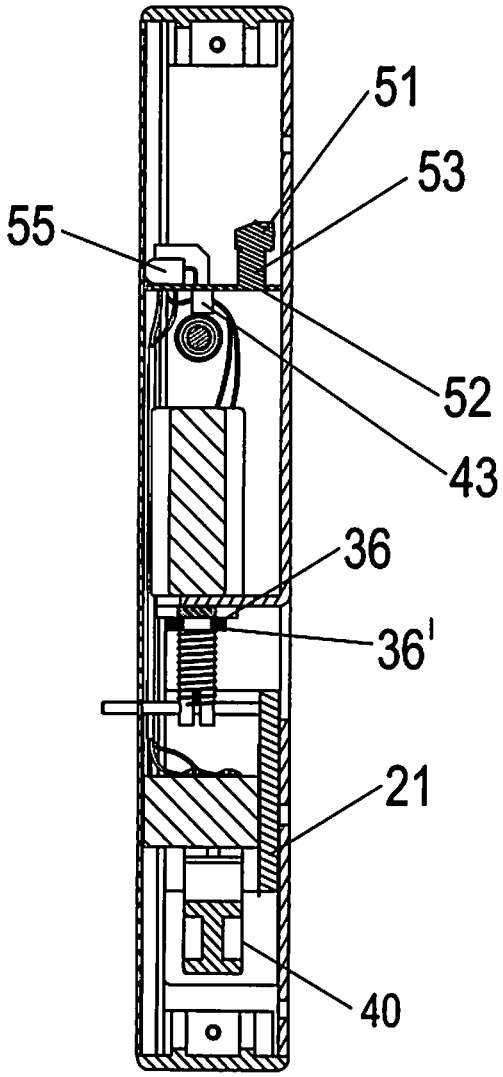
FIG. 6 is a cross-sectional view about lines 6-6 of FIG. 4.
Figure 8:
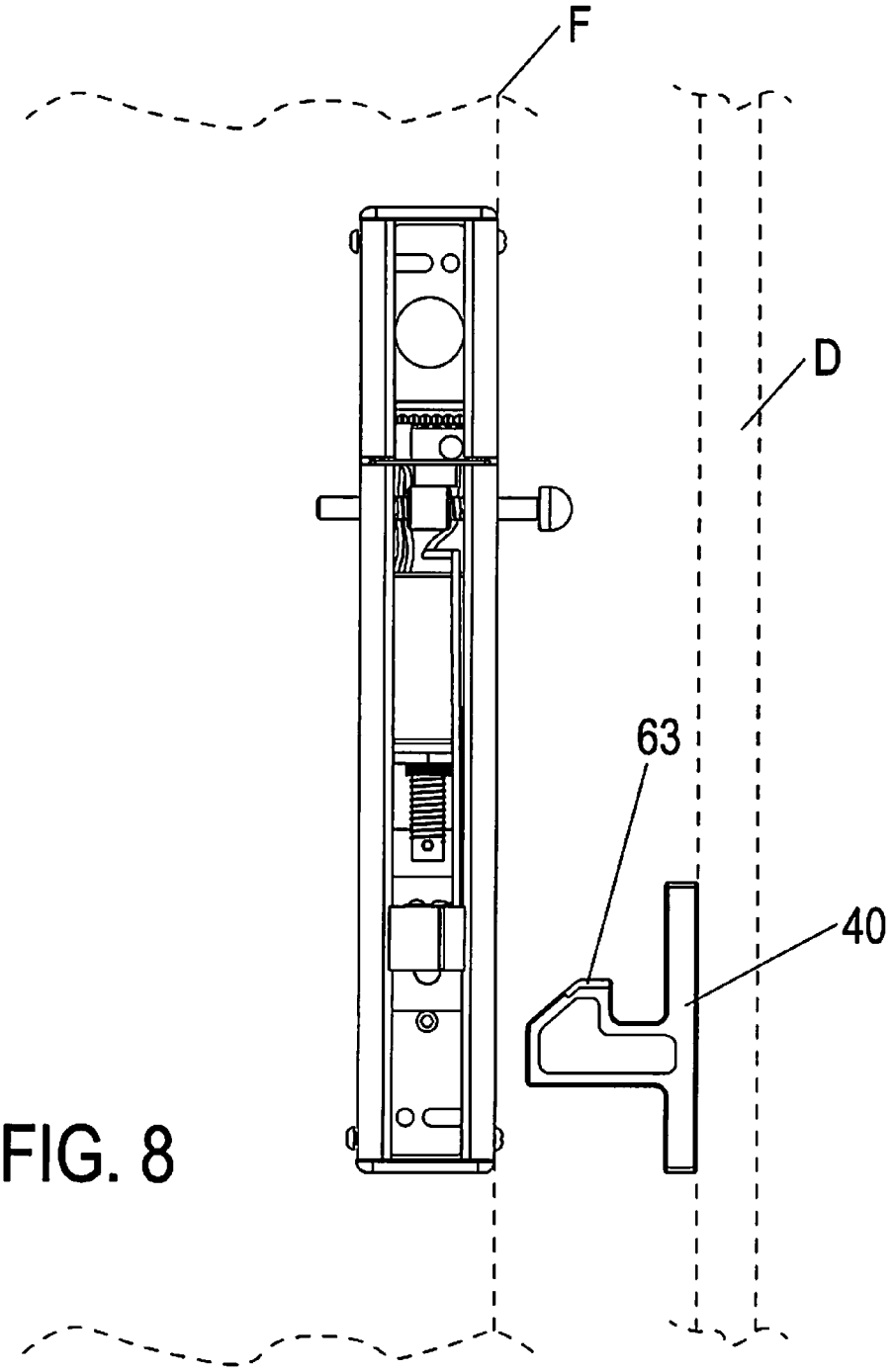
FIG. 8 is a front view of FIG. 1 with a keeper disengaged from the housing.

In a first form, the housing 11 is made of formed sheet metal comprising a three-sided elongated casing 13 and a two-sided right angle cover plate 15 with one panel 9 extending over the open side of the casing. The primary casing 13 defines an open-ended rectangular interior channel 17 which has a square cross-section 18 with ledges 19, 19' forming returns or guideways 20, 20'. The ledges 19, 19' serve as guides for the free edges 8, 8' of the slider 21 in advancing between two limits of travel. The slider member 21 is U-shaped and is designed to fit and slide within the channel 17. The slider member 21 is attached to a lower end of a plunger 33 and the upper and lower limits of travel of the slider 21 are controlled by retraction or extension of the plunger 33, to be discussed in greater detail. The slider member 21 has a designated range of travel and downward travel of the slider member is also restricted by a head 25 of a slider stop screw 26 extending from a rear interior portion 28 of the housing 11. Upward travel of the slider member 21 is prevented by the presence of a solenoid, to be discussed. End caps 22 and 24 are present on opposite ends of the housing 11. These caps may be of plastic construction, metal or formed as part of the stamped and formed housing 11. The housing 11 also includes a contact block 30 having dual contact members 32, 34 that are inserted and secured to the block 30. The contact block 30 is secured along the interior portion 28 of the slider member 21 with plate 38. On the lower end of the housing are two rectangular cutouts 12 and 14 that act as keeper-receiving openings and each communicating with one side of the channel 17. When the slider 21 is at its lowest extension, a sidewall 7 or 7' partially covers or closes a portion of the top of one of the keeper-receiving openings 12 or 14 as shown in FIG. 2. The keeper-receiving openings 12 and 14 are of a size sufficient to permit an L shaped leading end 16 of a keeper 40, to extend into the housing 11 so that the slider 21 can drop down behind it and lock it into place as shown in FIG. 8. When the slider 21 is retracted to its fullest extent, it clears each of the keeper-receiving openings, leaving space for pass through of the keeper 40. The keeper 40 is made up of a heavy duty plastic but may also be made up of other similar durable materials. The keeper 40 is slidably mounted on a stationary part of the hoisting system for slidable advancement across the path of advancement of the slider member 21 and has a stainless steel contact 63 on the exterior surface that engages with the slider contacts 32 and 34. The contacts may also be brass or any other conductive material without departing from the scope.

A first end 27 of the slider is connected to a solenoid 29 by means of a manual release dowel 31 secured to the interior portion 36 of the slider channel and extending into the inside of the channel. The solenoid 29 may be a latching solenoid, which is known in the prior art, having a plunger 33 that may be retracted inside the solenoid. The solenoid 29 includes a lock washer 36 and nut 36' as well. The dowel 31 is inserted through an opening 38 in the plunger 33 extending downwardly from the solenoid 29 and connected to the slider as described above. The plunger may include an exterior spring member 35 or an internal solenoid spring (not shown) as in FIG. 9. The exterior compression spring 35 keeps the slider in the locked position when not energized and also keeps the contacts 32 and 34 firm against the keeper contact 63 to eliminate breaking of the circuit should the door rattle.

Figure 7:
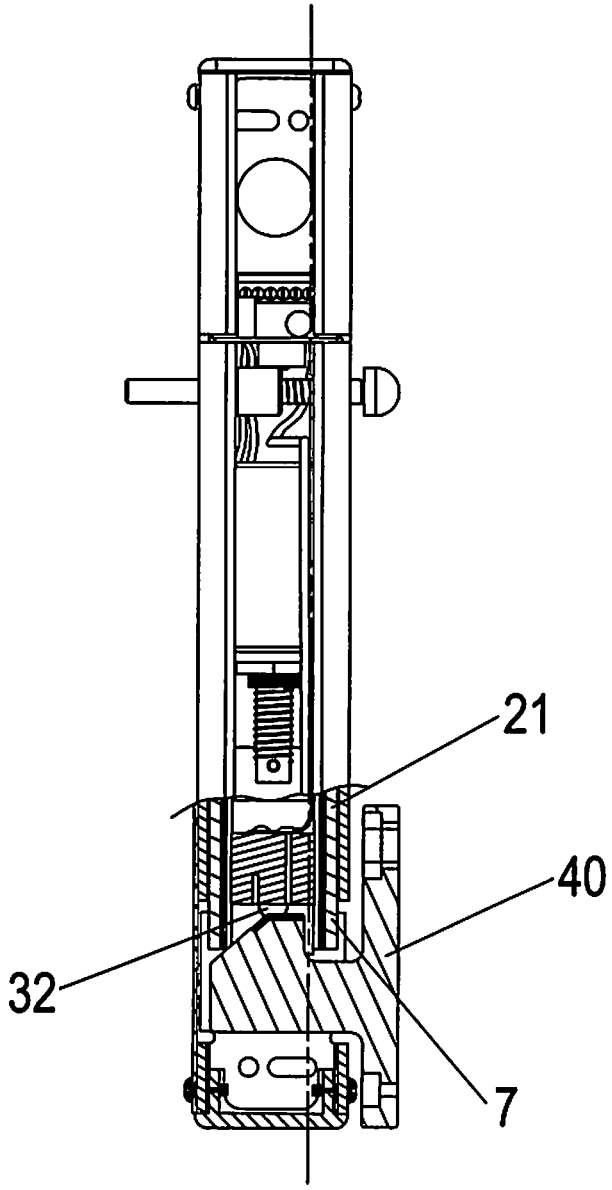
FIG. 7 is a front view of FIG. 1 with a keeper engaged.

The system also includes a cam system having a cam 37, a cam rod 39 extending through the housing 11 on both sides and two compression springs 41, 41' that keep the cam 37 centered on the rod 39. The cam and cam rod are bidirectional allowing movement in both directions and ensuring that there is sufficient travel in the cam rod 39 to allow the cam to move completely past an isolation or microswitch 43 in either direction. The cam 37 is aligned with the switch member 43 which is mounted on an interface board or printed circuit board 45 that is used to mechanically support and electrically connect the various components. When the cam 37 is aligned with the switch member 43, the circuit is open and provides an electrical connection to terminals 1 and 2 of the interface board only, creating a door closed circuit. Once the cam 37 is moved off-center, as shown in FIG. 7 and accomplished by closing the door D, the circuit is closed and the electrical connection is made up with the terminals 1 and 2 of the interface board only, activating the door closed circuit.

Figure 9:
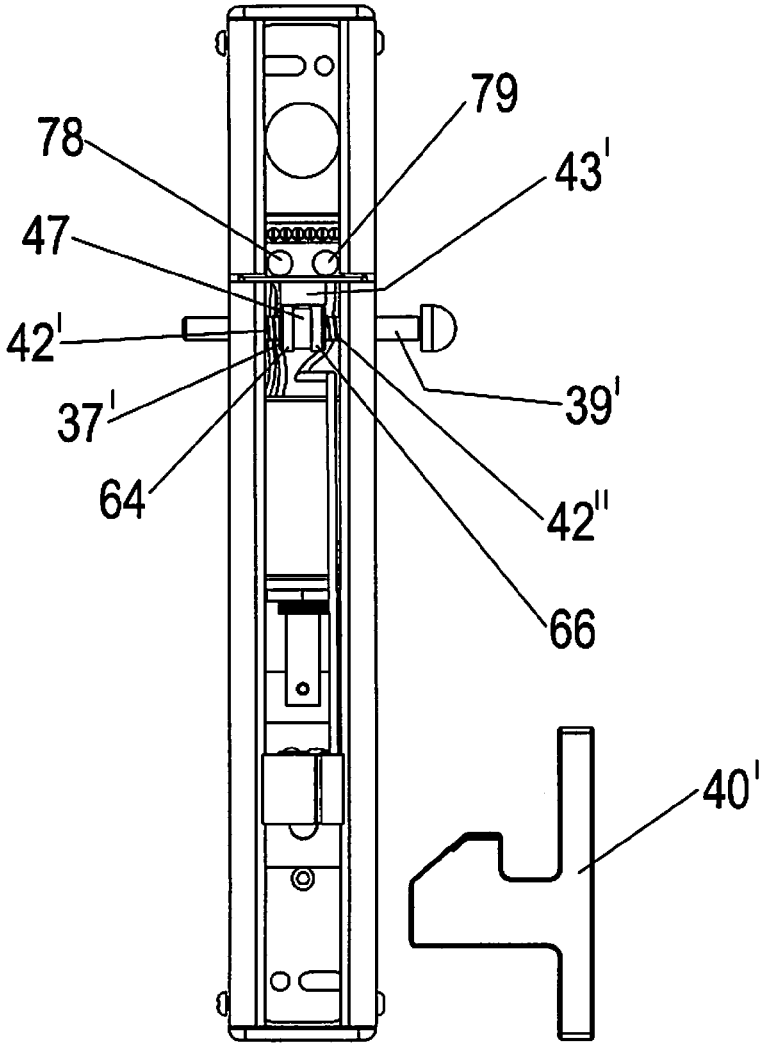
FIG. 9 is a front view of an alternate form of apparatus.
Figure 10:
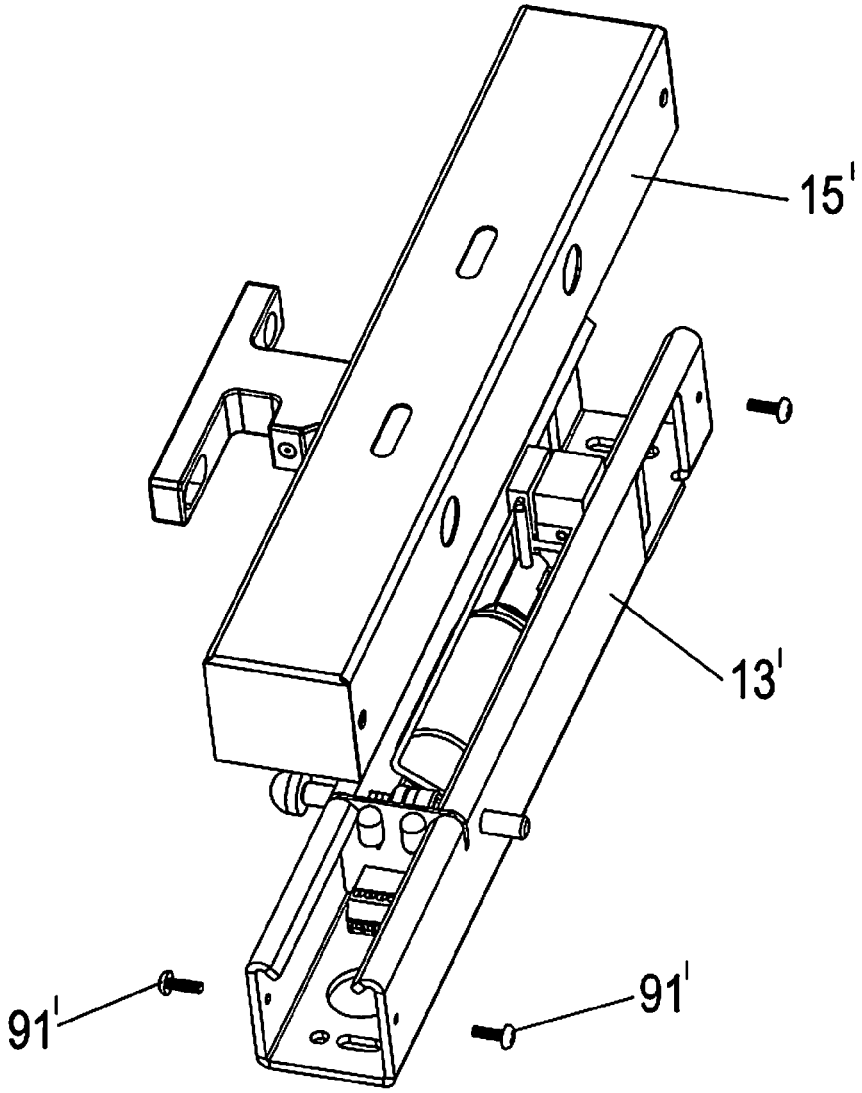
FIG. 10 is a perspective exploded view of FIG. 9.

The interface board 45 has a two-way door closed switch and is equipped with a full wave bridge rectifier 49 allowing the locking system to operate on either 24V AC or 24V DC. The board 45 further includes a wire connector 51 and receptacle 53, the isolation switch 43 mounted to the underside 52 of the interface board and activated by the cam 37 on the cam rod 39, and at least one LED indicator light 55, although in a second form as shown in FIGS. 9 and 10, at least two LED indicator lights 78, 79 are shown. The LED light will appear red when the safety circuit is closed. The interface board 45 also has plug and play capability or a CAT5 plug for easy field wire and install or replacement.

Figure 11:
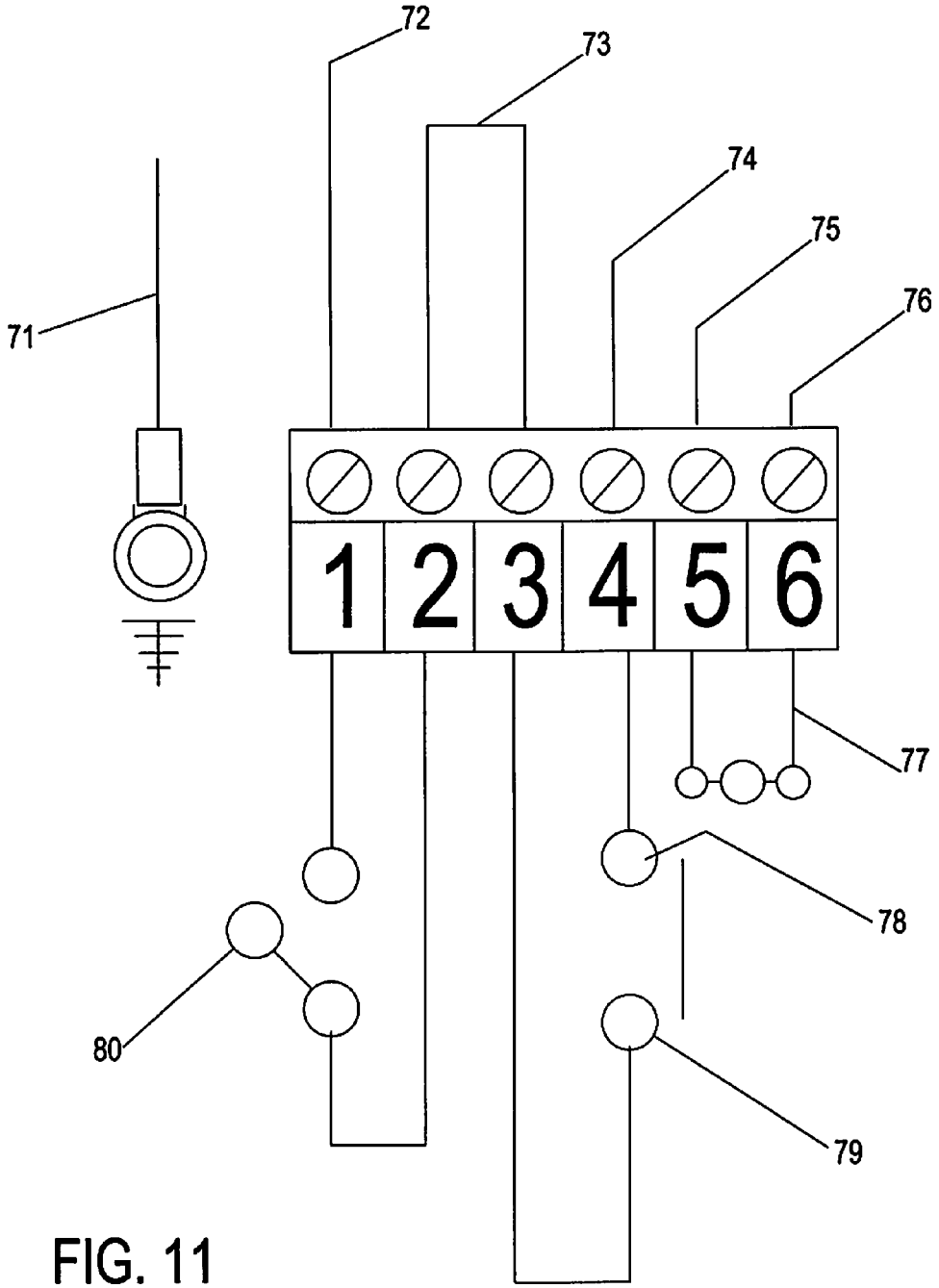
FIG. 11 illustrates a circuit drawing in one embodiment.
Figure 12:
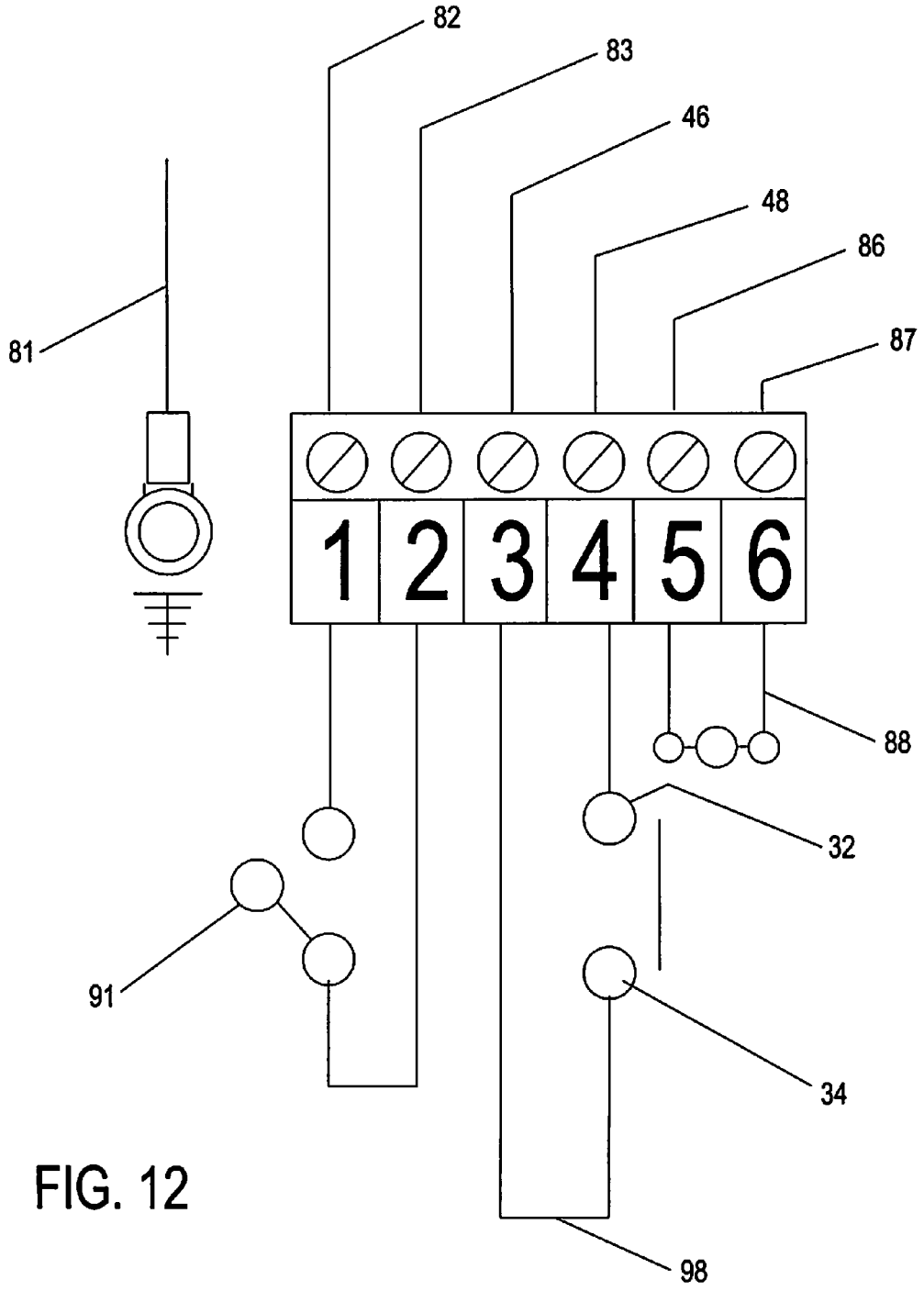
FIG. 12 illustrates a circuit drawing in another embodiment.

The wiring system is schematically shown in FIGS. 11 and 12. The interlock may be wired as a 4-wire or 6-wire system. The 4-wire schematic is shown in FIG. 11 and includes a lock housing ground lug 71, a door closed wire 72, a jumper wire 73, a door locked wire 74, a solenoid wire 75 and a second solenoid wire 76, a solenoid bridge 77, door locked contacts 78 and 79 and a door closed switch 80. The 6-wire system, as shown schematically in FIG. 12, includes a lock housing ground lug 81, a door closed wire 82, a second door closed wire 83, a door locked wire 46, a second door locked wire 48, a solenoid wire 86 and a second solenoid wire 87, a solenoid bridge 88, door locked contacts 32, 34 and a door closed switch 91. In general, the 6 wire locking system has two wires 46 and 48 for the door locked circuit, two wires for the solenoid and one ground wire 81 fastened to the housing. The wires are connected to the lock's interface board by a screw terminal type plug (not shown). This is distinguishable from the 4 wire system that has only a door locked circuit and a 4 wire plug terminal. Wires 72 and 74 are used for the door closed and door locked circuit and wires 75 and 76 connect to the solenoid which is powered through the opening and closing of the interface board switch 43'.

In operation of the first form, which is the 6 wire circuit shown in FIGS. 1-8 and FIG. 12, the housing 11 is installed in a hoistway door frame F and the keeper 40 is mounted in the door D as shown in FIG. 8. The contact block 30 has the two contacts 32 and 34 which are internally connected to the two circuit wires 46 and 48, wired together as part of the door locked circuit. The first wire 46 is wired in series with the jumper 98 and the second wire 48 becomes both the closed and locked circuit which is both electrical and mechanical. The contacts 32 and 34 are recessed in the internal slider 21 which drops down over the door keeper 40 and physically makes contact with the contact bar 16 on the keeper 40, thereby preventing manual interference with a metal object. The housing 11 mounts on a door jamb F or frame and the keeper 40 mounts to an inside door edge D.

When the door is opened, the cam rod 39 advances to neutral as shown in FIG. 8 and the cam 37 engages the switch member 43 opening the circuit and stopping current from being sent to terminals 1 and 2 or wires 82 and 83. The solenoid is activated by the lift controller. Activation of the solenoid 29 causes retraction of the plunger 33 into the solenoid as well as retraction of the slider 21, thereby releasing the keeper 40 from the housing 11. When the door D is closed, the keeper 40 advances through the keeper-receiving opening 14 and engagement between the contacts 32 and 34 with the keeper contact bar 16 is accomplished, creating the door locked circuit, as described above. The cam rod 39 and cam 37 are part of the door closed circuit with the cam rod extending through the housing 11 on both sides and making contact with an entry door D as it is being closed. As the door shuts, the rod 39 is forced in the opposite direction moving the cam 37 past the isolation switch 43. The circuit is closed, the plunger 33 extends downwardly causing the leading edge 16 of the keeper 40 to catch behind the slider 21, mechanically locking the door. While the door is closed and the door locked circuit, established by the keeper 40 making contact with the slider contacts 32 and 34, remains closed, the hoistway door cannot open and will not move. As the door is closing, the tapered leading edge 16 of the keeper 40 makes contact with the slider 21, lifting it. When the door is closed, the slider 21 drops behind the keeper 40, locking it, restoring the door locked circuit and allowing the control system to run.

The door lock contacts 32 and 34 are bi-directional and incorporated into the slider 21 allowing the lock to be used on a right or left hand door. The interlock receives input power 24v AC or DC from the lift controlling system that is installed with it and the wiring carries 24v AC or DC, from a power supply, a full wave rectifier 49. If the door is closed and the switch 43 is activated closed, the signal from the power supply flows through both circuits and the elevator car is able to move. If the circuits are open, due to an elevator door being in an open position and no contact between the keeper 40 and the slider 21, there is no current flow from both the switch 43 and the door locked circuits 32 & 34. The elevator car will be unable to move.

In another form, as shown in FIGS. 9 and 10, a cam 37' is of modified form having dual lobes 64, 66, a cam rod 39' extending through the housing 11' on both sides and two compression springs 42', 42" that keep the cam 37' centered on the rod 39'. The isolation switch 43' can be triggered by either of the two lobes on the cam 37' moving off center in either direction or returning to center from either side. When the interlock is not engaged by a keeper 40' on a closed door, the cam 37' is centered on the housing 11' by the compression springs 42' and 42". In this position, an isolation switch 43' rests in a center groove 47 of the cam 37', the power circuit is open and is not activated. Activation of the circuit occurs when the cam 37' is off center and the isolation switch member 43' is engaged with one the dual lobes 42' or 42". Biasing means (not shown) hold the plunger into one rest position until an impulse of reverse current pulls the plunger back into the solenoid. This is a reverse circuit to that described above. FIG. 10 demonstrates an alternate form with a primary housing 11' and a secondary cover 15'. Variations in the housing, such as a single unit housing with pre-formed end members from the side panels (not shown, may be used for economy and/or specific design requests without departing from the scope of this description.

It is therefore to be understood that even though numerous characteristics and advantages of the embodiments shown and described have been set forth in the foregoing description, together with the details of the structure and function of the embodiments, the disclosure is illustrative only, and changes may be made within the principles of the embodiments to the full extent indicated by the broad general meaning of the terms and reasonable equivalents thereof.

I claim:

1. An elevator comprising in combination:

a hoistway door pivotal between an open position and a closed locking position;

a metal housing having an elongated substantially rectangular vertically extending channel;

said channel having a substantially square cross-section with a pair of vertically extending, opposed facing longitudinal guideways;

a U-shaped slider member mounted within said channel and movable through said guideways;

said slider member having a drive member for retracting and advancing said slider member; and a stationary keeper in facing relation to said door insertable horizontally into a keeper—receiving opening in one side of said channel in said housing to lock said door in the closed position and having a contact engageable with contacts on said slider member when in the closed position.

2. An elevator according to claim 1 wherein said slider member is advanceable between said guideways.

3. An elevator according to claim 2 wherein said drive member includes a plunger extending downwardly from a solenoid and an isolation switch activated by a cam.

4. An elevator according to claim 3 wherein said keeper releasably engages said contacts to close an electrical circuit and make up a door locked circuit.

5. An elevator according to claim 4 wherein said electrical circuit includes a multiple wire interface board interconnecting said contacts and said drive member.

6. An elevator according to claim 4 wherein movement of said cam off of said isolation switch activates said door locked circuit.

7. An elevator according to claim 2 wherein said drive member includes a cam having a centered groove and dual lobe members, each of said dual lobe members engageable with an isolation switch.

8. An elevator according to claim 1 wherein said slider member includes a sidewall movable through said channel.

* * * * *